US005998723A

United States Patent [19]

Suzuki

[11] Patent Number: 5,998,723

[45] Date of Patent: Dec. 7, 1999

[54] APPARATUS FOR FORMING MUSICAL TONES USING IMPULSE RESPONSE SIGNALS AND METHOD OF GENERATING MUSICAL TONES

[75] Inventor: Takashi Suzuki, Hamamatsu, Japan

[73] Assignee: Kawai Musical Inst. Mfg.Co., Ltd., Japan

[21] Appl. No.: 09/163,197

[22] Filed: Sep. 30, 1998

[30] Foreign Application Priority Data

Sep. 30, 1997 [JP] Japan ..... 9-284547

[51] Int. Cl.[6] ..... G10H 1/06; G10H 7/00

[52] U.S. Cl. ..... 84/622

[58] Field of Search ..... 84/601–605, 608, 84/622, 659

[56] References Cited

U.S. PATENT DOCUMENTS 5,286,913 2/1994 Higashi .

5,567,901 10/1996 Gibson et al. .

5,578,780 11/1996 Wachi .

*Primary Examiner*—Jeffrey W. Donels

*Attorney, Agent, or Firm*—Birch, Stewart, Kolasch & Birch, LLP

[57] ABSTRACT

A desired tone signal is generated by the impulse response signals that are repetitively generated, and a tone is formed. Impulse response signals of a predetermined length corresponding to the frequency characteristics of the tone signal to be generated are repetitively generated. The recurring period of the impulse response signals repetitively generated varies depending upon a pitch-determining factor. The rate of generating the impulse response signals is changed depending upon a timbre-determining factor different from the pitch-determining factor, independently of the recurring period. Thus, the timbre of the tone signal formed from the impulse response signals is freely changed independently of the pitch.

20 Claims, 10 Drawing Sheets

APPARATUS FOR FORMING MUSICAL TONES USING IMPULSE RESPONSE SIGNALS AND METHOD OF GENERATING MUSICAL TONES

BACKGROUND OF THE INVENTION

1. Field of the Invention

The present invention relates to an apparatus and a method of forming musical tones and, particularly, to an apparatus and a method of forming tone signals using impulse response signals.

2. Description of the Background Art

In the conventional apparatus for forming musical tones, the impulse response waveform signals have not been controlled. The impulse response waveform signals are simply sampled and stored, and are repetitively read out, the period of repetition varying depending upon a specified pitch. In this case, the period of repetition becomes shorter with an increase in the specified pitch, and the period of repetition becomes longer with a decrease in the specified pitch. The rate of reading out the impulse response waveform signals remains constant and does not change irrespective of whether the pitch is high or low.

According to the conventional apparatus, however, the impulse response waveform signals could be simply read out and applied to musical tones, but the timbre of the musical tone could not be varied. The frequency components (characteristics) of musical tone vary depending upon the filters, and the timbre of musical tone can be changed.

However, the frequency characteristics (spectral envelope) of musical tone vary depending upon a change in the rate of reading the impulse response waveform signals (depending upon the rate of generation of the impulse response waveform signals). As the rate of generating the impulse response wave signals changes, the frequency characteristics expand or contract on a frequency axis, whereby the frequency characteristics vary and the timbre changes. In this case, when the rate of reading the impulse response waveform signals is interlocked to the recurring period of reading, the timbre is not determined independently of the pitch; i.e., the timbre varies depending upon the pitch.

SUMMARY OF THE INVENTION

A first object of the present invention is to determine the timbre independently of the pitch, and a second object of the invention is to form new tone signals by using impulse response waveform signals.

According to the present invention, there are repetitively generated impulse response signals of a predetermined length corresponding to the frequency characteristics of a tone signal that is to be generated. The recurring period of the impulse response signals that are repetitively generated varies depending upon a pitch-determining factor. The rate of generating the impulse response signals is varied depending upon a timbre-determining factor different from the above-mentioned pitch-determining factor, independently of the recurring period.

Therefore, the timbre of a tone signal generated from the impulse response signals varies independently of the pitch; i.e., the timbre freely changes independently of the pitch. Moreover, a desired tone signal is generated by the repetitive generation of the impulse response signals, and a novel tone is formed.

According to the present invention, furthermore, the waveform of the repetitively generated impulse response signals is changed over depending upon the musical factor that is generated. Accordingly, the waveform of the impulse response signal varies depending upon a change in the pitch and/or a change in the timbre.

EMBODIMENT OF THE INVENTION

1. Outline of the Embodiment.

The impulse response signals are stored for each of the musical factors (timbre, pitch, tone pitch range, touch, sounding time and field of play), and are selected by an impulse signal selection unit 52 depending upon the musical factors. The recurring period T of the selected impulse response signals changes depending upon the pitch-determining factor (period coefficient f) (step 16), and the rate of generating the impulse response signals changes depending upon the timbre-determining factor (spectrum coefficient r) independently of the recurring period (steps 24 to 29). The timbre (FIG. 8) of the tone signal formed from the impulse response signals changes independently of the pitch (FIG. 7).

2. Principle of the Invention.

Figure 7:
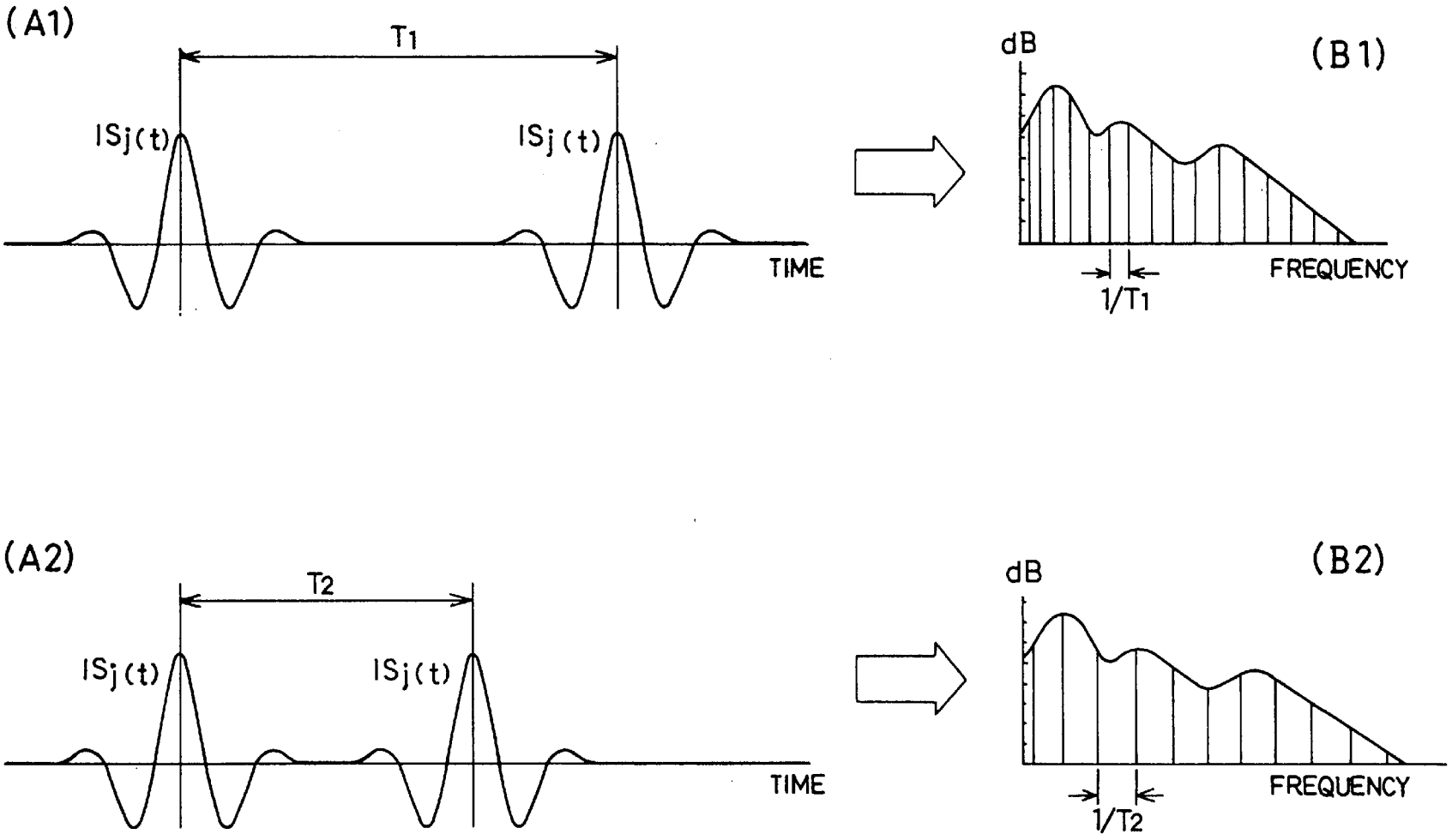
FIG. 7 illustrates the principle of the present invention.
Figure 8:
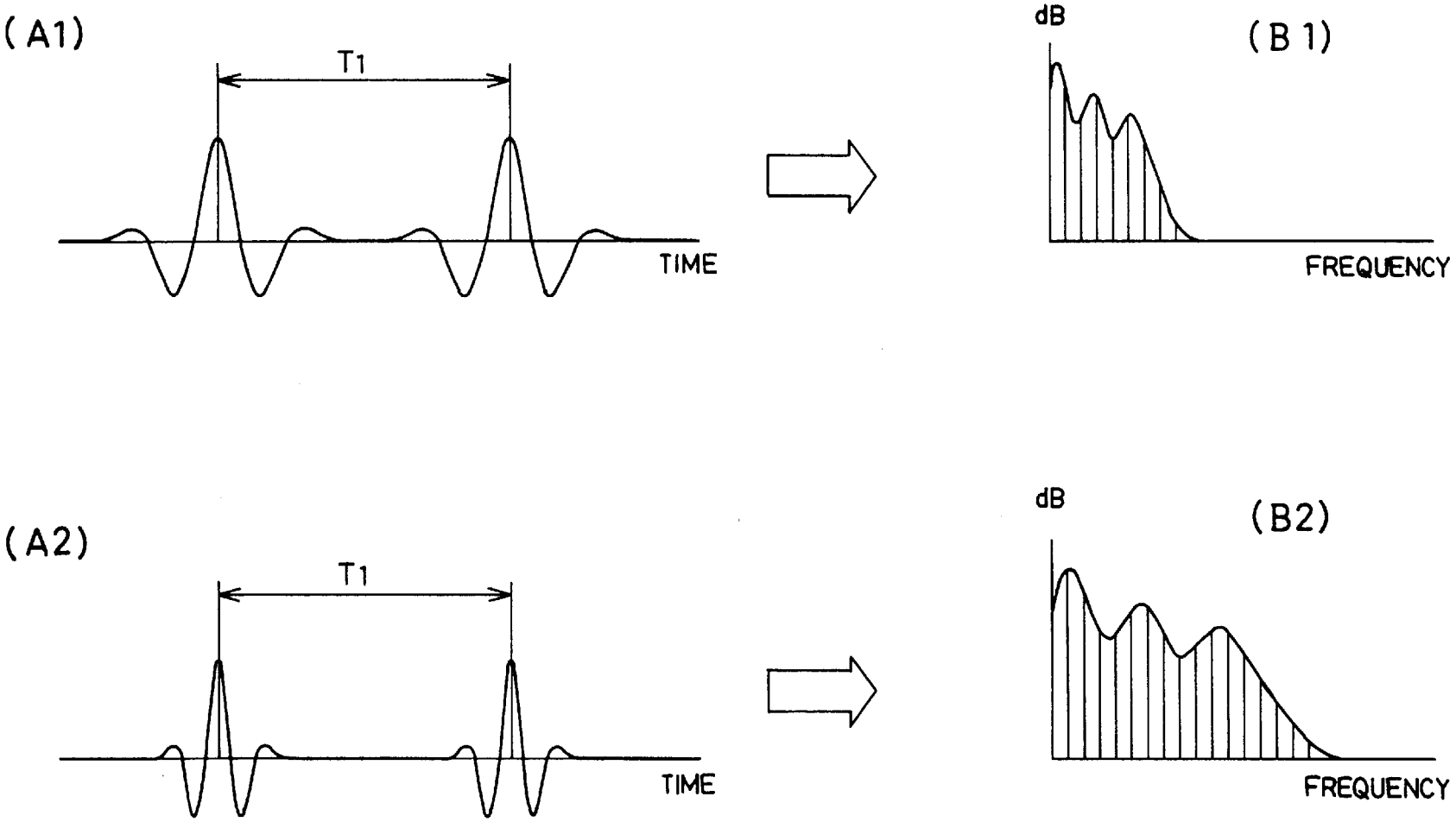
FIG. 8 illustrates the principle of the present invention.

FIGS. 7 and 8 illustrate the principle of the present invention. FIG. 7 illustrates frequency characteristics (spectrum envelope, frequency spectral component characteristics, formant characteristics) (the same holds hereinafter) of a tone synthesized and formed by the output of the impulse response signals ISj (t), when the recurring period of the impulse response signals ISj (t) is T1 or T2. The recurring period T determines the pitch of the tone that is formed. Therefore, the recurring period T is determined by the pitch data and is fetched as a period coefficient f. In the impulse response signal ISj (t), the period coefficient f is a pitch data.

As the recurring period T of the impulse response signals ISj (t) becomes short and the pitch becomes high, the frequency characteristics do not change so much or do not change at all as shown in FIGS. 7(B1) and 7(B2), whereby the density of the frequency components decreases but the width of formant does not change. As the recurring period T changes, therefore, the pitch changes but the timbre (frequency components, formant characteristics) does not change.

Figure 1:
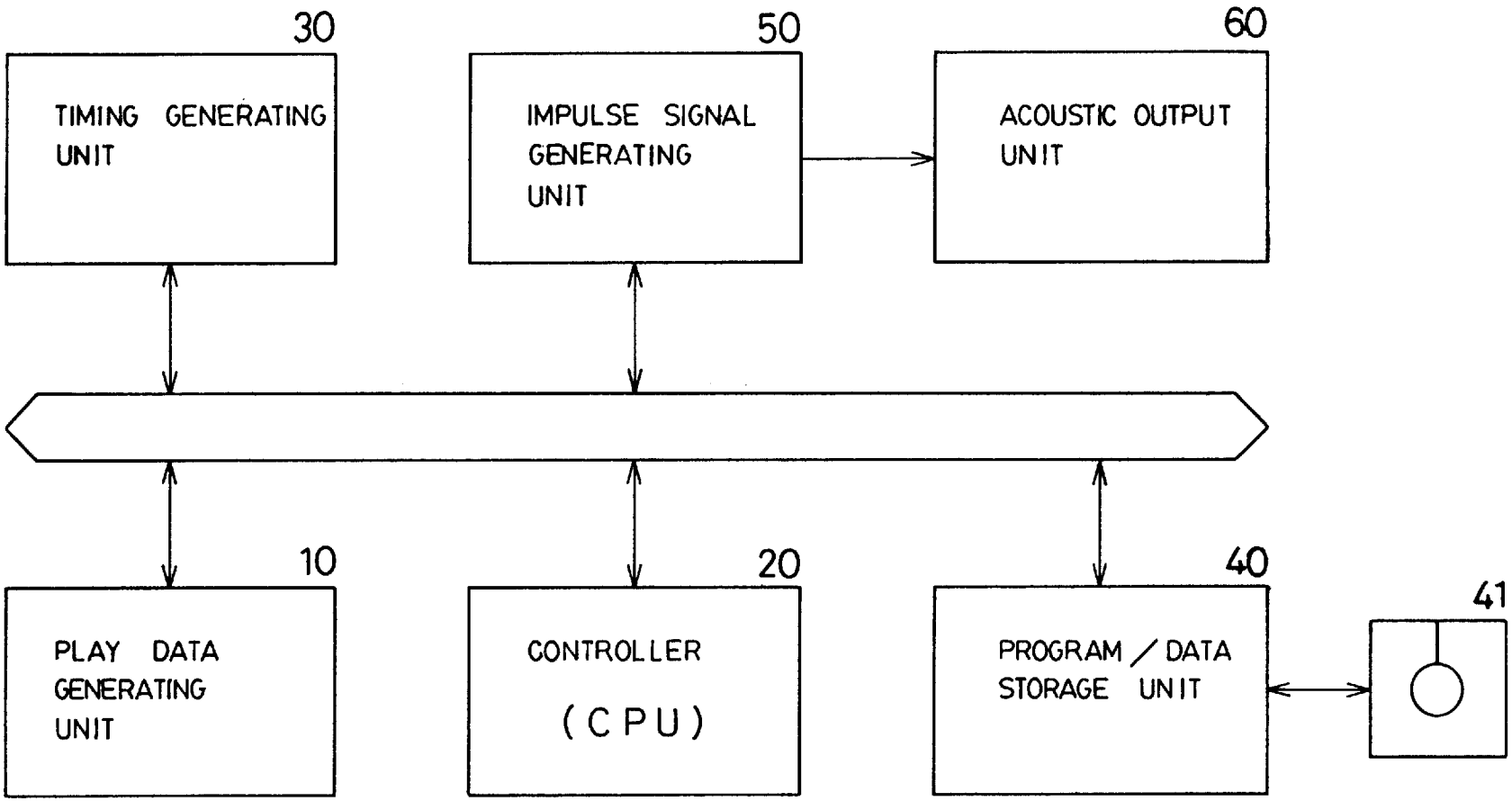
FIG. 1 illustrates the whole circuit of an apparatus for forming musical tones.

The impulse response signals ISj (t) are stored for each of the musical factors in an impulse signal storage unit 51 (FIG. 2) of an impulse signal-generating unit 50 (FIG. 1). The impulse response signal ISj (t) that is stored is one of the two impulse response signals ISj (t) of FIGS. 7 (A1) or 7 (A2), which is illustrating a state where the impulse response signals ISj (t) are being repetitively read out.

FIG. 8 illustrates the frequency characteristics (spectrum envelope, frequency spectral component characteristics and formant characteristics) of a tone synthesized and formed by the output of the impulse response signals ISj (t), when the recurring period of the impulse response signals ISj (t) is the same but the rate of reading the impulse response signals ISj (t) is different. The rate of reading the impulse response signals ISj (t) determines the timbre (frequency components, formant characteristics) of the tone that is formed. Therefore, the rate of reading is determined by the musical factor data which has no relation to the pitch, e.g., determined by the timbre data, and is fetched as a spectrum coefficient r. In the impulse response signal ISj (t), the spectrum coefficient r is a timbre data.

As the rate of reading the impulse response signals ISj (t) increases and the length of the impulse response signals ISj (t) is shortened, the density of the frequency components does not so much change or does not change at all as shown in FIGS. 8(B1) and 8(B2), but the frequency characteristics (frequency spectrum component characteristics, formant characteristics) change and the width of the frequency spectrum (formant) increases. Therefore, when the rate of reading the signals changes, the timbre (frequency components, formant characteristics) changes but the pitch does not change.

Operations such as linear prediction and spectrum are effected for a predetermined length of the tone signal that is to be formed, and the impulse response signals ISj (t) are formed and are stored. According to the spectrum, for example, the tone signal of a predetermined length is Fourier-transformed at a high speed through a Fourier transform unit, and is converted into a frequency power spectrum.

The power spectrum that is converted is subjected to the logarithmic conversion through a logarithmic converter and is further subjected to the fast inverse Fourier transform through an inverse Fourier transform unit so as to be converted into a spectrum of frequency. A causal window from a multiplier and from a window function generator is applied to the spectrum which is then converted into a complex spectrum. The complex spectrum is subjected again to the fast Fourier transform through the Fourier transform unit and is returned back to a frequency band from which a spectral envelope is found.

Examples of the spectral envelope are shown in FIGS. 7(B1), 7(B2) and 8(B1), 8(B2). The spectral envelope is subjected to the exponential conversion through an exponential converter, and is subjected to the fast inverse Fourier transform through the inverse Fourier converter so as to be returned back to the frequency. Accordingly, there are formed sampling data of impulse response signals of a minimum phase, which are then stored as the impulse response signals ISj (t) in the impulse signal storage unit 51.

3. Overall Circuitry.

FIG. 1 illustrates an overall circuitry of a tone-generating apparatus. A play data-generating unit 10 generates play data (tone-generating data). The play data are for generating a tone. The play data-generating unit 10 may be a sound instruction device played by manual operation, an automatic play device, a variety of switches, or an interface.

The play data (tone-generating data) are musical factor data inclusive of pitch (tone pitch range) data (tone-determining factor), sounding time data, field-of-play data, number-of-sounds data or degree-of-resonance data. The sounding time data represent the passage of time from the start of sounding a tone. The field-of-play data represent part of play, part of tone, part of musical instrument, etc., and are corresponded to, for example, melody, accompaniment, code, base and rhythm, or are corresponded to an upper keyboard, a lower keyboard or a foot keyboard.

The pitch data are fetched as key number data. The key number data include octave data (tone pitch range data) and tone name data. The field-of-play data are fetched as part number. The areas of play are distinguished depending upon the part number which is set depending upon the area of play of a tone that is sounded.

The sounding time data are fetched as tone time data, and are based upon time count data from a key-on event or substituted by envelope phase. The sounding time data have been disclosed in the specification and drawings of Japanese Patent Application No. 219324/1994 as data related to the passage of time from the start of sounding.

The number-of-sounds data represent the number of tones that are simultaneously sounded. For example, on/off data of an assignment memory are based on the number of tone "1", which is found from flow charts of FIGS. 9 and 15 of Japanese Patent Application No. 242878/1994, FIGS. 8 and 18 of Japanese Patent Application No. 2476855/1994, FIGS. 9 and 20 of Japanese Patent Application No. 276857/1994, and FIGS. 9 and 21 of Japanese Patent Application No. 276858/1994.

The degree-of-resonance data represent the degree of resonance of a tone that is being sounded with other tones. When a frequency of pitch of one tone and a frequency of pitch of another tone establish small ratios of integers such as 1:2, 2:3, 3:4, 4:5, and 5:6, then, the value of the degree-of-resonance data becomes great. When the ratios of integers are as large as 9:8, 15:8, 15:16, 45:32 and 64:45, then, the value of the degree-of-resonance data becomes small. The degree-of-resonance data can be read out from a resonance correlation table 53 or a resonance ratio table 54 shown in FIG. 7 of Japanese Patent Application No. 314818/1989.

The sound instruction device will be a keyboard instrument, a stringed instrument, a wind instrument, a percussion instrument and/or a keyboard of a computer. An automatic playing device automatically reproduces play data that are stored. The interface is a MIDI (musical instruments digital interface) or the like, and receives play data from, or sends play data to, the device that is connected.

The play data-generating unit 10 is equipped with various switches inclusive of timbre tablet, effect switch, rhythm switch, pedal, wheel, lever, dial, handle and touch switch, which are for musical instruments. Tone control data are generated by these switches. The tone control data are musical factor data and include timbre data (timbre-determining factor) touch data (speed/strength of sounding instruction operation), effect data, rhythm data, sound image (stereo) data, quantize data, modulation data, tempo data, sound volume data and/or envelope data.

These musical factor data, too, are combined with the play data (tone data) and are input through a variety of switches, and are further combined with the automatic play data or are combined with the play data transmitted and received through the interface. The touch switch is provided for each of the sound instruction devices, and generates initial touch data that represent the quickness and strength of touch as well as after touch data.

The timbre data are corresponded to the kinds of musical instruments (sounding media) such as a keyed instrument (piano, etc.), a wind instrument (flute, etc.), a stringed instrument (violin, etc.) and a percussion (drum, etc.), and are fetched as tone number data. The envelope data include an envelope level, an envelope speed, an envelope time and an envelope phase.

Such musical factor data are sent to a controller 20 where a variety of signals that will be described later, data and parameters are changed over to determine the content of the tone. The play data (tone-generating data) and tone control data are processed by the controller 20, a variety of data are sent to an impulse signal-generating unit 50, and an impulse response signal ISj (t) is generated. The controller 20 includes CPU, ROM and RAM.

A program/data storage unit 40 (internal storage medium) comprises a storage unit such as ROM, a writable RAM, a flash memory or an EEPROM, and in which can be written and stored (installed/transferred) a program of a computer stored in a data storage unit 41 (external storage medium) such as an optical disk or a magnetic disk. In the program/data storage unit 40 are further stored (installed/transferred) programs transmitted from an external electronic musical instrument or a computer through the MIDI device or the transmitter/receiver. The program storage medium includes a communication medium.

The installation (transfer/copy) is automatically executed when the data storage unit 41 is set into the tone-forming apparatus or when the power source of the tone-forming apparatus is turned on, or is executed by the operation by an operator. The above-mentioned program corresponds to a flow chart that will be described later, with which the controller 20 executes a variety of processings.

The apparatus may store, in advance, another operating system, system program (OS) and other programs, and the above-mentioned program may be executed together with these OS and other programs. When installed in the apparatus (computer body) and executed, the above-mentioned program executes the processings and functions described in the claims by itself or together with other programs.

Moreover, part or whole of the program may be stored in, and executed by, one or more apparatuses other than the above-mentioned apparatus, and the data to be processed and the data/program that have been processed already may be exchanged among the above-mentioned apparatus and other apparatuses through communication in order to execute the present invention by the above-mentioned apparatus and by the other apparatuses.

In the program/data storage unit 40 are stored the above-mentioned musical factor data, the above-mentioned variety of data and various other data. These variety of data include data necessary for the time-division processing as well as data to be assigned to the time-division channels.

The impulse signal-generating unit 50 repetitively generates the impulse response signals ISj (t) of a predetermined length, and a sound is output from an acoustic output unit 60. The recurring period of the impulse response signals ISj (t) that are repetitively generated changes depending upon the pitch data. Furthermore, the rate of reading the generated impulse response signals ISj (t) (rate of generation) changes depending upon the timbre data different from the pitch data and upon the musical factor data irrelevant to the pitch, and the recurring period and the rate of reading can be changed independently of each other.

The impulse response signal ISj (t) has a predetermined finite length corresponding to the spectrum envelope of a tone signal that is to be generated. The impulse signal-generating unit 50 forms a plurality of tone signals simultaneously by the time-division processing and produces a polyphonic sound.

The timing-generating unit 30 outputs timing control signals to every circuit so that the whole circuitry of the tone-generating apparatus is maintained in synchronism. The timing control signals include clock signals of all periods, as well as a signal of a logical product or a logical sum of these clock signals, a signal of a period of a channel-dividing time of the time-division processing, and channel number data j.

4. Impulse Signal-Generating Unit 50.

Figure 2:
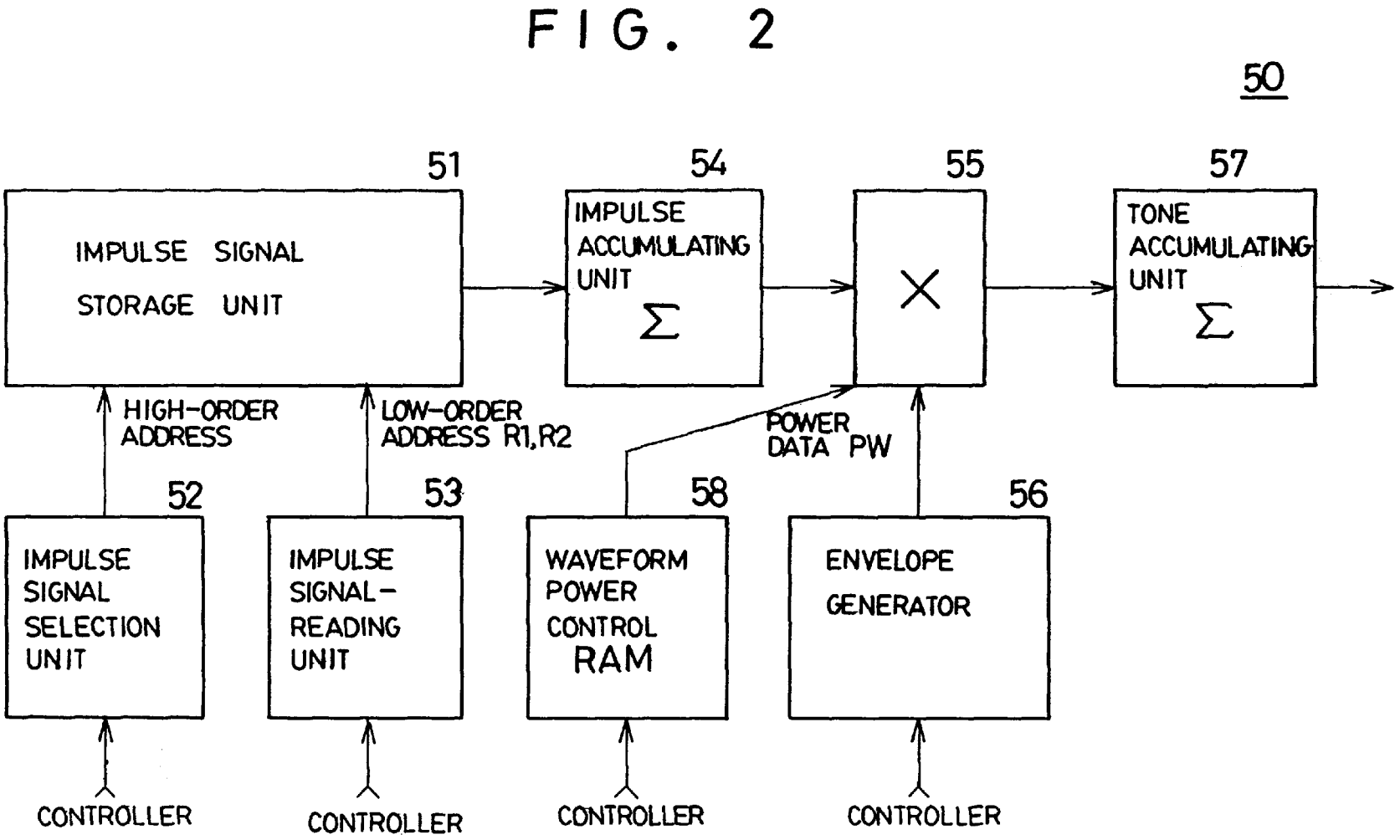
FIG. 2 illustrates an impulse signal-generating unit 50.
Figure 10:
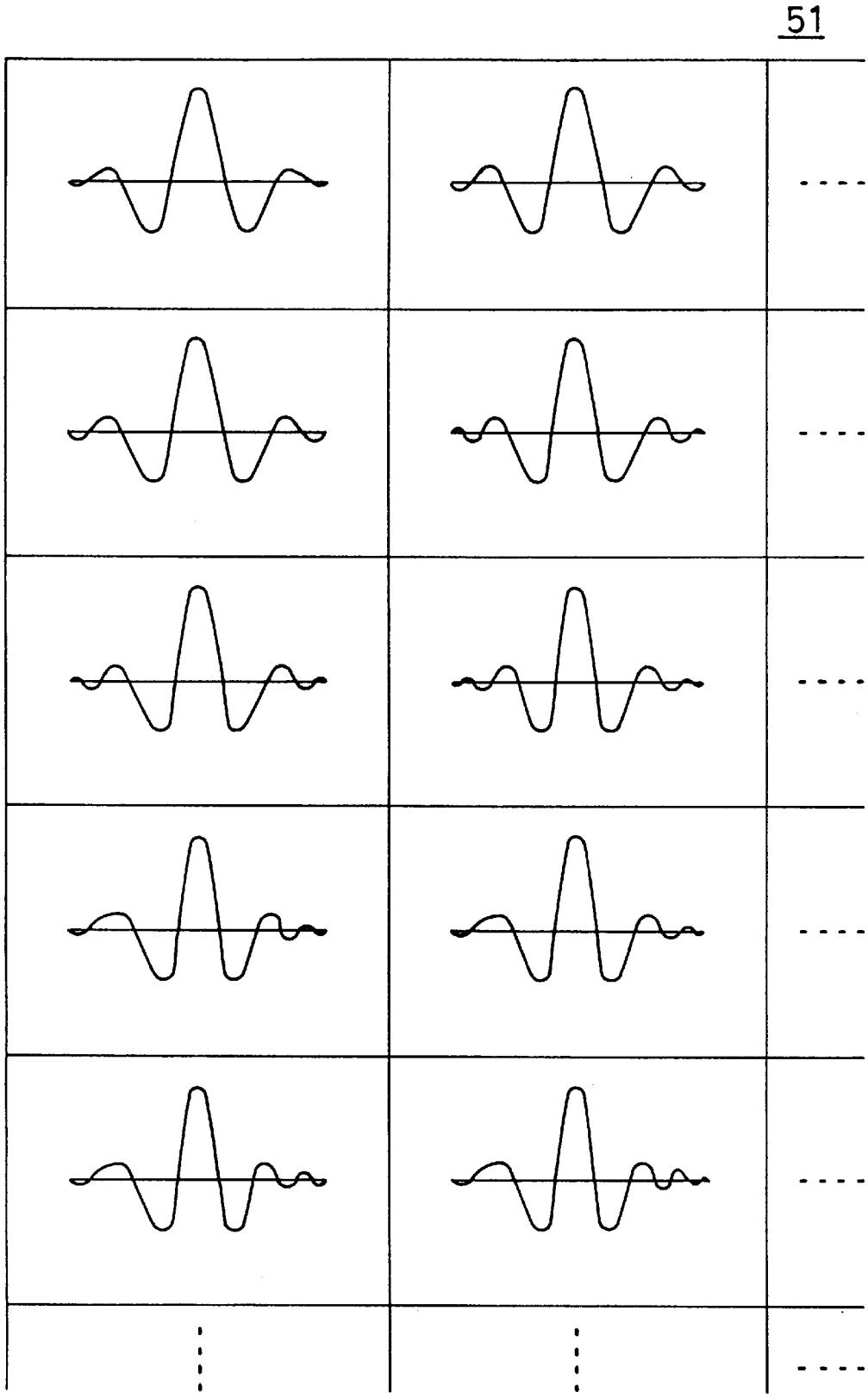
FIG. 10 is a diagram illustrating various impulse response signals ISj (t) stored in the impulse signal storage unit 51.

FIG. 2 illustrates the impulse signal-generating unit 50. The impulse signal storage unit 51 stores a variety of kinds of impulse response signals ISj (t) as shown in FIG. 10. The impulse response signals ISj(t) have dissimilar waveforms which, when synthesized into a tone signal, produce different timbres. These impulse response signals ISj (t) are corresponded to the musical factor data, and are stored in a multiplexed manner for each of timbre, touch, pitch (tone pitch range) or sounding time, field of play, envelope phase, number-of-sounds data and degree-of-resonance data.

For example, the impulse response signals ISj (t) are stored differently for each of the timbres. Among them, the impulse response signals ISj (t) of one kind of timbre are differently stored for each of the touches. Among them, the impulse response signals ISj (t) of one kind of touch are differently stored for each of the sounding times, are differently stored for each of the pitches, are differently stored for each of the fields of play, and are differently stored for each of the envelope phases.

The musical factor data are converted through the controller 20 into high-order read address data for specifying a variety of impulse response signals ISj (t) The read address data are stored in the impulse signal selection unit 52 and are fed to the impulse signal storage unit 51 thereby to select the impulse response signals ISj (t). When the musical factor data change for each of the tones or during the sounding, the high-order address data are changed over, and the impulse response signals ISj (t) that are read out are changed over, too.

When the musical factor data are related to the pitch, the waveform of the impulse response signal changes depending upon a change in the pitch, and the timbre of a tone signal that is synthesized changes, too, depending upon the pitch. When the musical factor data are related to the data other than the pitch, the waveform of the impulse response signal changes depending upon a change in the timbre, touch, sounding time and field of play and, besides, the timbre of the synthesized tone signal changes depending upon a change in the timbre, touch, sounding time and field of play.

The impulse signal selection unit 52 has memory areas corresponding to the number of time-division channels, and the high-order address data corresponding to musical factors of the tones assigned to the channels are stored in the respective memory areas, are read out by the channel number data j from the timing-generating unit, and are fed to the impulse signal storage unit 51.

The impulse response signals ISj (t) of the impulse signal storage unit 51 are read out by low-order read address data R1 and R2 from the impulse signal-reading unit 53. The low-order read address data R1 and R2 are increased at a speed corresponding to the musical factor data other than the pitch data. Therefore, the rate of reading the impulse response signals ISj (t) is not determined by the pitch data. The impulse response signals ISj (t) are repetitively read out. The recurring period changes depending upon the pitch data, and the recurring period and the rate of reading are determined independently of each other.

The impulse response signals ISj (t) read out from the impulse signal storage unit 51 are accumulated and synthesized for each of the channels through an impulse accumulating unit 54. The envelope signals from the envelope generator 56 are multiplied and synthesized for each of the channels through a multiplier 55, the tone signals of all channels are accumulated and synthesized through a tone accumulating unit 57, and a sound is output from an acoustic output unit 60.

The musical factor data (envelope data), i.e., envelope speed data ES, envelope level data EL and envelope phase data EF are fed from the controller 20 to an envelope generator 56, and are stored for each of the channels. The speeds and levels of phases of envelopes of the channels are set based upon the musical factor data (envelope data), and the shapes of the envelopes are determined. The envelope signals are generated in a time-divided manner for each of the channels and are sent to the multiplier 55.

5. Impulse Signal-Reading Unit 53.

Figure 3:
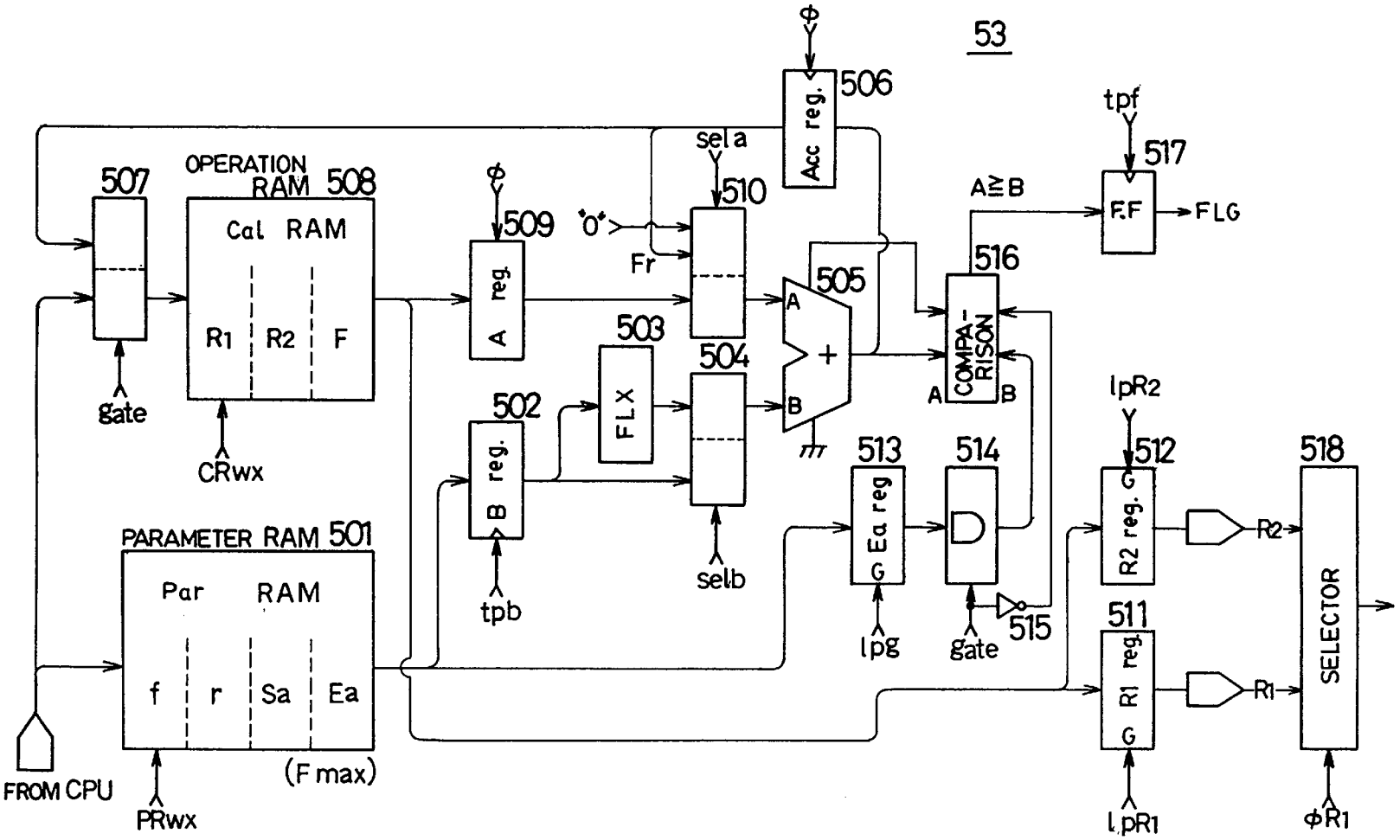
FIG. 3 illustrates an impulse signal-reading unit 53 in the impulse signal-generating unit 50.

FIG. 3 illustrates the impulse signal-reading unit 53 in the impulse signal-generating unit 50. A frequency coefficient f, a spectrum coefficient r, a waveform head address Sa and a waveform end address Ea from the controller (CPU) 20 are stored in a parameter RAM 501 for each of the time-division channels. Depending upon the cases, a period end value Fmax is stored in the parameter RAM 501 for each of the time-division channels. In the parameter RAM 501 are formed memory areas of a number corresponding to the number of the time-division channels, and the coefficients f, r and addresses Sa, Ea corresponding to the tones assigned to the channels are stored in the corresponding memory areas. When the data f, r, Sa and Ea are sent at all times in a time-divided manner from controller 20, the parameter RAM 501 may have only one memory area.

The period coefficient f and the period end value Fmax determine the length of recurring period of the impulse response signals ISj (t), and determine the pitch of the tone that is formed. As the period coefficient f is repetitively accumulated and reaches the period end value Fmax, the impulse response signals ISj (t) are repetitively read out. The accumulated value of the period coefficient f serves as a period count value F. The period coefficient f and the period end value Fmax are determined by the pitch data (key number data), and are converted from the key number data. The length of the recurring period determines the pitch of the tone signal that is generated.

Either the period coefficient f or the period end value Fmax may be secured. In the embodiment of FIG. 3, the period end value Fmax is set to a maximum value ("1111- - - 11" or "111- - - 1100- - - 0") that can be taken by a period count value F. However, the period end value Fmax is not stored.

The spectrum coefficient r determines the rate of reading (generating) the impulse response signals ISj (t), determines the frequency characteristics (spectrum envelope, frequency spectrum component or formant shape) of the impulse response signals ISj (t) and determines the timbre of the formed tone. The spectrum coefficient r is repetitively accumulated from the waveform head address Sa to the waveform end address Ea, and are fed to the impulse signal storage unit 51 as low-order read address data R1 and R2. As the low-order read address data R1 and R2 reach the waveform end address Ea, the impulse response signal ISj (t) is not read out until the period count value F reaches the period end value Fmax.

The spectrum coefficient r is determined by the musical factor data that have no relation to -the pitch, and are converted, for example, from the timbre data (tone number data), touch data, sounding time data (tone time data), field-of-play data (part number data), number-of-sounds data or degree-of-resonance data.

The spectrum coefficient r or the period coefficient f from the parameter RAM 501 is sent through B register to 502, through or not through FLX 503 to selector 504, to an adder 505 where it is added to a the low-order read address data R1 and R2 up to that moment or to a period count value F, which is, then, sent, through an accumulation register 506 and a selector 507, to an operation RAM 508 and is stored therein. In the operation RAM 508 are formed memory areas of a number corresponding to the number of the time-division channels, and the data R1, R2 and F corresponding to the tones assigned to the channels are stored in the corresponding memory areas. The FLX 503 converts the data based on a floating point into the data based on a fixed decimal point.

Figure 9:
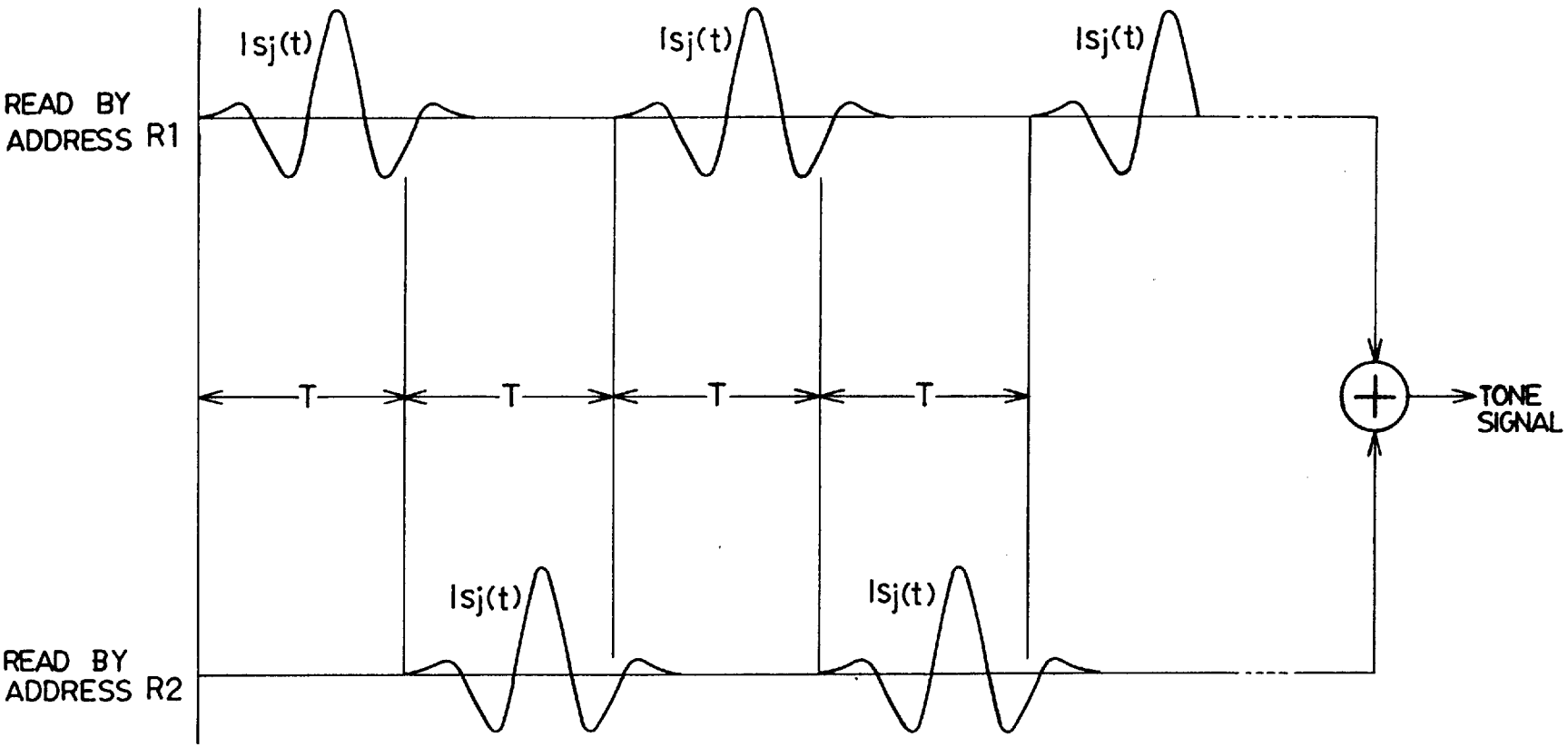
FIG. 9 illustrates a state where the impulse response signals IS; (t) are read out from an impulse signal storage unit 51.

The data R1, R2 and F are sent from the operation RAM 508 to the adder 505 through an A-register 509 and a selector 510. Furthermore, the data R1 and R2 are sent, through an R1-register 511 and an R2-register 512, to a selector 518 where they are alternatingly selected and are sent to the impulse signal storage unit 51. Among the period count values F from the accumulation register 506, the low-order fraction data Fr or the data "0" is fed to the adder 505 through the selector 510. The selector 518 is changed over by a clock signal $\phi$ R1. A period of the clock signal $\phi$ R1 is equal to a divided time of one channel as shown in FIG. 9.

The initial value of the low-order read address data R1 is "0", the initial value of the low-order read address data R2 is a waveform end address Ea, and the initial value of a period count value F is "0". These initial values are stored in the operation RAM 508 from the controller 20 through the selector 507.

The waveform end address value Ea (period end value Fmax) is fed from the parameter RAM 501 to a comparator 516 through an Ea-register 513 and a group of AND gates 514. To the comparator 516 are further fed low-order read address data R1, R2 or period count value F from the adder 505. When the low-order read address data R1 and R2 reach a waveform end address value Ea or when the period count value F reaches the maximum value "111- - - 11" or a value "111- - - 1100- - - 0" (period end value Fmax) approximate to the maximum value, a detection signal is sent to a flip-flop 517 and is sent to the controller (CPU) 20.

A carry-out signal Cout from the adder 505 is fed as a group of high-order bits of the comparator 516. A gate signal from the group of AND gates 514 is inverted through an inverter 515, and is fed as a group of high-order bits to the comparator 516 so that the bit number is conformed.

The waveform head address Sa and the waveform end address Ea, too, are determined by the musical factor data, and are converted from, for example, pitch data (key number data), timbre data (tone number data), touch data, sounding time data (tone time data), field-of-play data (part number data), number-of-sounds data and/or degree-of-resonance data, and are stored in the corresponding channel memory areas in the parameter RAM 501. The waveform head address Sa and the waveform end address Ea select one of a variety of impulse response signals ISj (t). In this case, the impulse signal selection unit 52 can be omitted.

6. Overall Processing.

Figure 4:
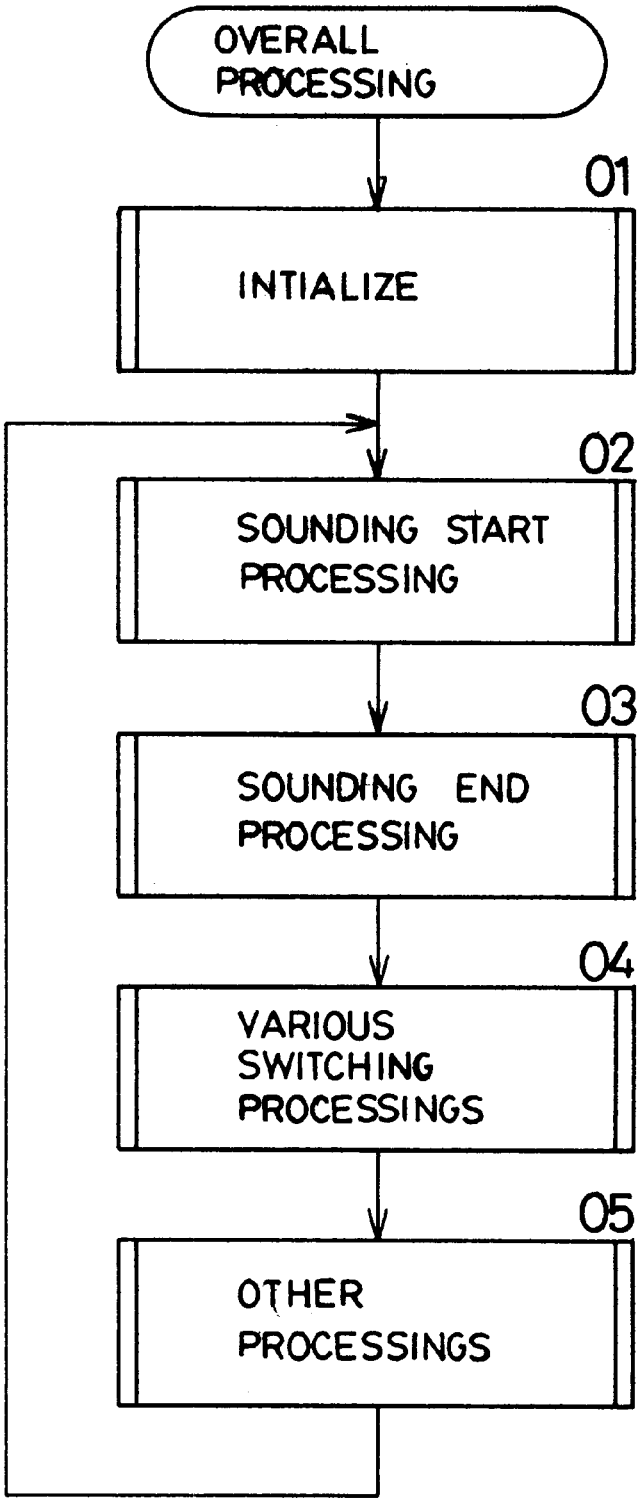
FIG. 4 is a flow chart of the whole processing.

FIG. 4 is a flow chart of the overall processing executed by the controller (CPU) 20. The overall processing is started by the turn-on of the power source of the tone-forming apparatus, and is repetitively executed until the power source is turned off.

First, a variety of initialization processings are executed for the program/data storage unit 40 (step 01), and a sounding start processing is executed based on the manual play or the automatic play by the sounding instruction device or the automatic play device in the play data-generating unit 10 (step 02).

In the sounding start processing, a tone related to a key-on event is assigned to an empty channel that is searched. The content of the tone is determined depending upon the play data (tone-generating data) from the play data-generating unit 10, musical factor data in the tone control data, and musical factor data that have been stored already in the program/data storage unit 40.

Then, a sounding end (attenuation) processing is executed based on the manual play or the automatic play using the sounding instruction device or the automatic play device in the play data-generating unit 10 (step 03). In the sounding end (attenuation) processing, a channel to which a tone of a key-off event is assigned is searched, and the tone is attenuated to end the sounding. In this case, the envelope phase of a tone related to the key-off event is released, and the envelope level gradually approaches "0".

Besides, upon operating a variety of switches of the play data-generating unit 10, the musical factor data corresponding to the switches are fetched and are stored in the program/data storage unit 40, whereby the musical factor data are changed (step 04). Thereafter, other processings are executed (step 05), and the processing is repeated from the step 02 up to the step 05.

7. Processing for Generating Impulse Response Signals ISj(t).

Figure 5:
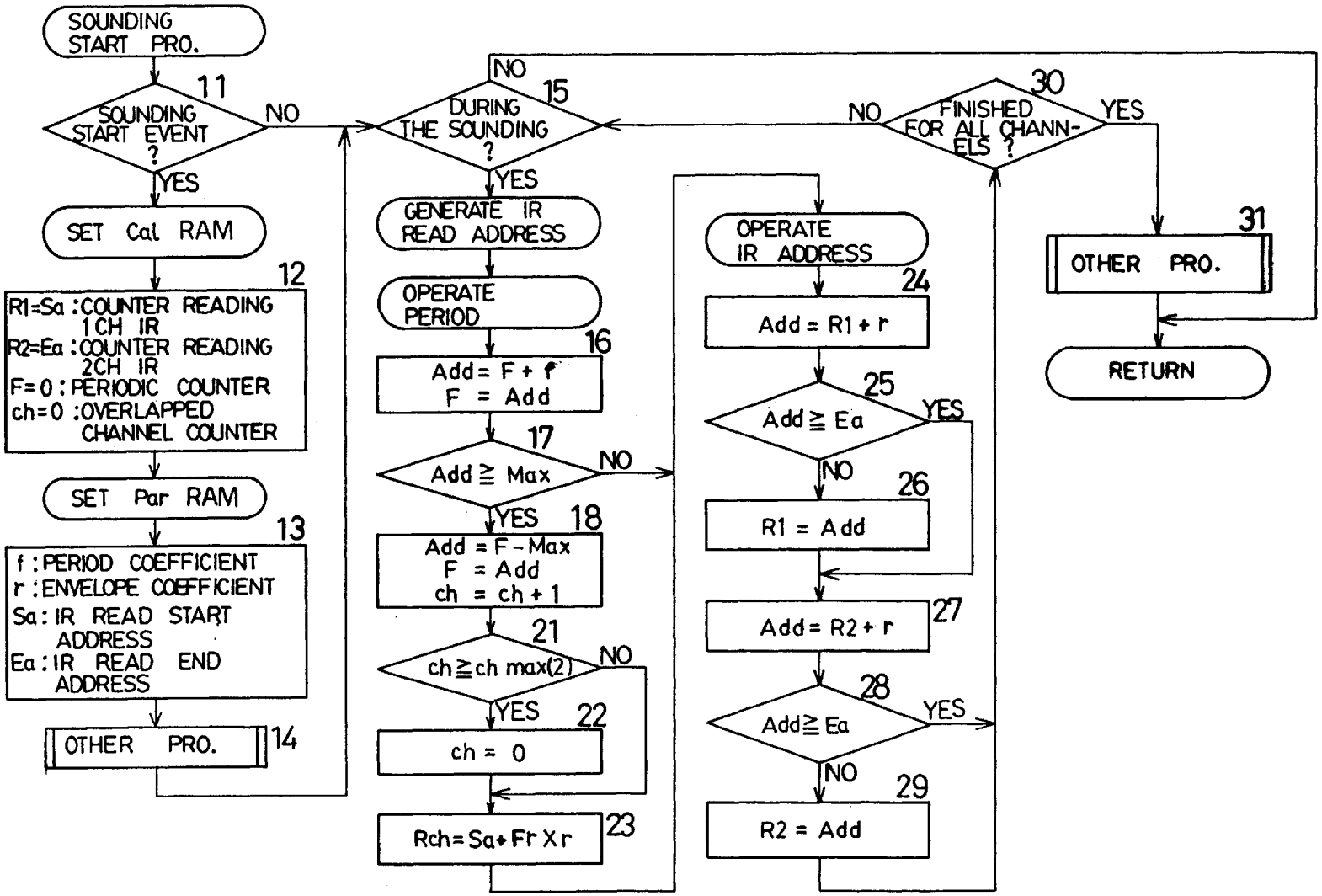
FIG. 5 is a flow chart of the sounding processing at the step 02.

FIG. 5 is a flow chart of the sounding start processing executed at the step 02 by the controller (CPU) 20. In this processing, impulse response signals ISj (t) are generated. The flow chart of FIG. 5 is executed for all time-division channels.

When a key-on event (sounding start event) based on the manual play or the automatic play is sent to the controller 20 from the sounding instruction device or the automatic play device in the play data-generating unit 10 (step 11), an empty channel is searched, and onto the area of the assignment memory of the searched empty channel are written on/off data of "1", period coefficient f depending upon the pitch, envelope coefficient r depending upon the timbre, touch data TC, part number data PN, tone time data TM of "0", power data PW depending upon the pitch, envelope speed ES, envelope level EL, envelope phase EF of "1", and other flags and data Sa, Ea, Fmax that will be described later.

Furthermore, the low-order read address data R1 of "0", low-order read address data R2 set to the waveform end address Ea and period count value F of "0" are stored in a corresponding channel memory area of the operation RAM 508, and a corresponding channel area of the overlapped channel counter (program/data storage unit 40) is reset to "0" (step 12).

Next, the period coefficient f and the period end value Fmax are converted from the key number data (pitch data) KN and are stored in a corresponding channel memory area in the parameter RAM 501. The spectrum coefficient r is converted from the tone number data (timbre data), touch data, tone time data (sounding time data) or part number data (field-of-play data) and is stored in a corresponding channel memory area in the parameter RAM 501 (step 13), and other processings are executed (step 14).

The waveform head address Sa and the waveform end address Ea are converted from the key number data (pitch data), tone number (timbre data), touch data, tone time data (sounding time data) or part number data (field-of-play data), and are stored in a corresponding channel memory area in the parameter RAM 501 (step 13). The waveform head address Sa and the waveform end address Ea select one of the above-mentioned variety of impulse response signals ISj (t). In this case, the impulse signal selection unit 52 may be omitted.

When there is a tone at the start of key-on (start of sounding) or during the key-on (during the sounding) (step 15), the period coefficient f is added (accumulated) to the period count value F (step 16). When the added value (accumulated value) is larger than the period end value Fmax ("1111- - - 11" or "111- - - 1100- - - 0") (step 17), the period end value Fmax is subtracted from the period count value F, and the end number of the period count value F is corrected (step 18).

The overlapped channels are changed over (steps 18, 21 and 22), a decimal data Fr of low order in the period count value F is added to the waveform head address Sa of the channels that are changed over (step 23), and the initial value of the low-order read address data R1 or R2 is corrected.

In the overlapped channels, the two impulse response signals ISj (t) are alternatingly read out in a time-dividing manner, are output as a tone, and a plurality of tones are output in a polyphonic manner through separate time-division channels as described earlier. Depending upon the value (ch=0, 1) of the overlapped channels, read of the two impulse response signals ISj (t) is distinguished.

When the time for reading an impulse response signal ISj (t) is longer than the recurring period of the impulse response signal ISj (t), the preceding impulse response signal ISj (t) is overlapped on the next impulse response signal ISj (t). Therefore, when the above two impulse response signals ISj (t) are separately read out by the division of the channel, the two impulse response signals ISj (t) are read out in parallel and are overlapped one upon the other. The number of the channels may not be smaller than two as a matter of course.

Then, the spectrum coefficient r is added to the low-order read address data R1 until the waveform end address Ea is reached (steps 24, 25 and 26), and the spectrum coefficient r is added to the low-order read address data R2 until the waveform end address Ea is reached (steps 27, 28 and 29). Due to the two low-order read address data R1 and R2, the two impulse response signals ISj (t) are read out in parallel from the impulse response signal ISj (t) storage unit 51 and are overlapped one upon the other in the impulse accumulating unit 54. The above-mentioned processings from the step 15 to the step 29 are repeated for all time-division channels (step 30), and other processings are executed (step 31).

8. Time Chart for the Impulse Signal-Reading Unit 53.

Figure 6:
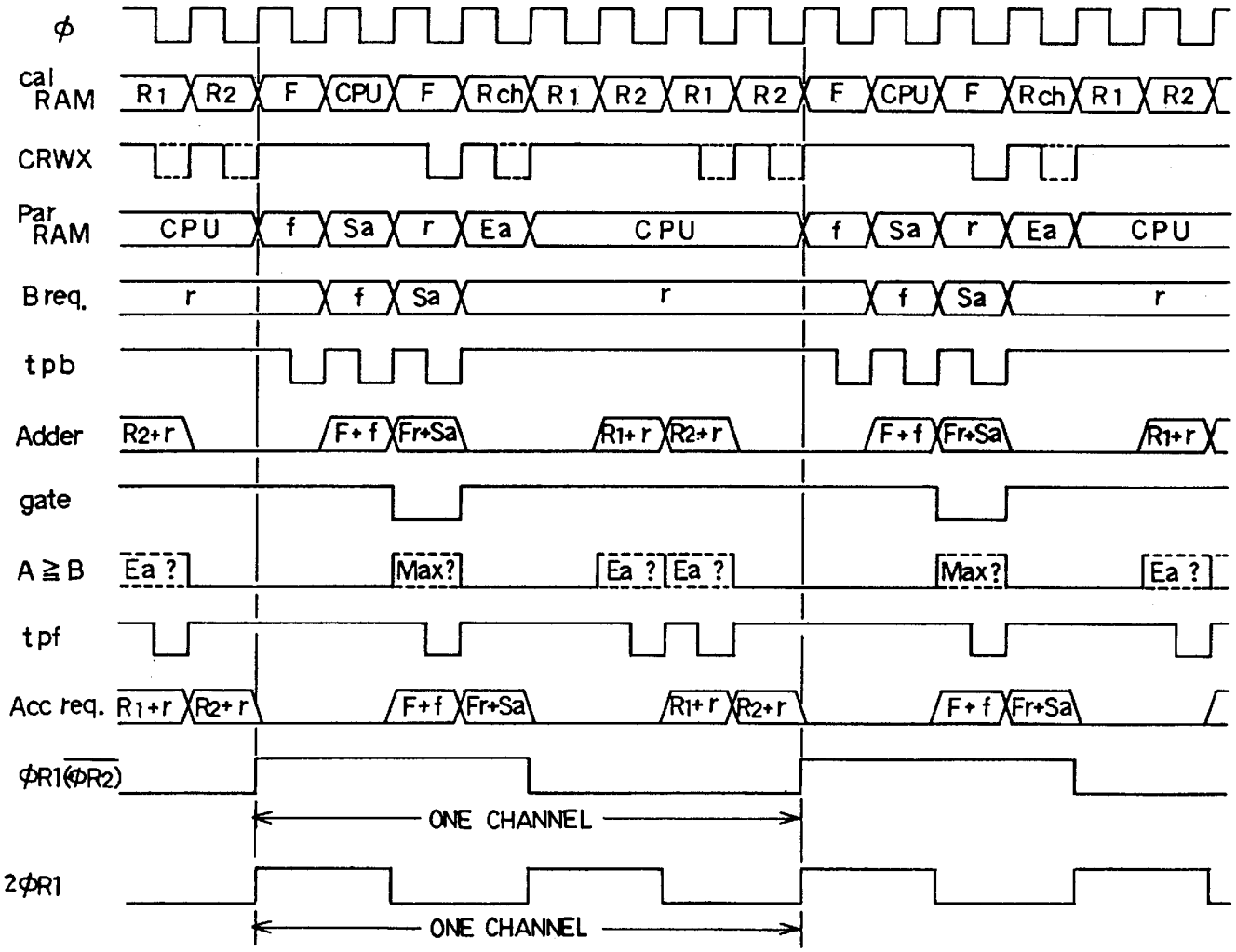
FIG. 6 is a time chart of the operations of the impulse signal-reading unit 53.

FIG. 6 is a time chart illustrating the operations of the units of the impulse signal-reading unit 53. As described above, the data are written/read out, into and from, the parameter RAM 501 and the operation RAM 508, the selectors 504, 507 and 510 are changed over, the data are stored in the registers 502, 506, 509, 511, 512 and 513, the data are stored in the flip-flop 517, and the group of AND gates 514 is enabled/disenabled (opened/closed) and change of the enable/disenable is controlled. As the change-over control signals, there are used various timing control signals from the timing-generating unit.

The period end value Fmax that is stored in the parameter RAM 501, is written/read out. In a waveform of which the high level and low level are indicated by a dotted line in the waveform of the time chart, the high level/low level is assumed when there exists/does not exist the write data or when the comparator 516 is detected/not detected.

9. Reading State.

FIG. 9 illustrates a state of reading the impulse response signals ISj (t) from the impulse signal storage unit 51. Upon the sounding start (key-on), the first impulse response signal ISj (t) is read out by the low-order read address data R1 (step 24). An increment of the low-order read address data R1 is started at a rate of the spectrum coefficient r.

At the same time, an increment of the period count value F is started at a rate of the period coefficient f (steps 15 and 16). As the period count value F reaches the period end value Fmax (step 17), a reading of the second impulse response signal ISj (t) is started by the low-order read address data R2 despite that the first impulse response signal ISj (t) is still being read out (step 27). An increment of the low-order read address data R2, too, starts at a rate of the spectrum coefficient r.

After the passage of the second period T from the start of sounding (step 17), a reading of a third impulse response signal ISj (t) is started by the low-order read address data R1 despite that the second impulse response signal ISj (t) is still being read out (step 24).

After the passage of the third period T from the start of sounding (step 17), a reading of a fourth impulse response signal ISj (t) is started by the low-order read address data R2 despite that the third impulse response signal ISj (t) is still being read out (step 27).

Thus, the two impulse response signals ISj (t) are alternatingly read out due to the two low-order read address data R1 and R2. Therefore, despite that the impulse response signals ISj (t) are longer than the recurring period T, the preceding impulse response signal ISj (t) is continuously generated at the end of each period T, and the next impulse response signal ISj (t) is generated being overlapped thereupon. These impulse response signals ISj (t) are synthesized and output as a tone signal.

The number of the impulse response signals ISj (t) that are time-divisionally read out as a tone signal may exceed "2". In response to this, the number of the low-order read address data increases like R1, R2, R3, R4, - - - and the number of the steps 24 to 26 and 27 to 29 increases, too.

The number of the impulse response signal ISj (t) that is time-divisionally read as a tone signal may be "1". In this case, the length of the impulse response signal ISj (t) becomes shorter than the recurring period T. It is therefore determined whether the impulse response signal ISj (t) is shorter than the recurring period T or not. When it is shorter, the processings of the steps 27 to 29 are omitted, and only one system is needed for time-divisionally reading the impulse response signals ISj (t). The length of the impulse response signal ISj (t) is found by dividing a difference between the waveform end address Ea and the waveform head address Sa by the spectrum coefficient r. Similarly, the recurring period T is found by dividing the period end value Fmax by the frequency coefficient f.

The present invention is in no way limited to the above-mentioned embodiment only but can be modified in a variety of ways without departing from the spirit and scope of the invention. For example, the period end value Fmax may not be set but may be fixed to a maximum value that can be assumed by the period count value F. In this case, the pitch of the tone signal is determined by the period coefficient f only.

The former half and the latter half of the impulse response signal ISj (t) have the same shape, but may have different shapes. Furthermore, the former half only of the impulse response signal ISj (t) may be stored, and may be read out in a reversely folded manner thereby to form a latter-half signal. The impulse response signal ISj (t) may be the one formed by sampling and storing the sound from an external source and subjecting it to the conversion such as the spectrum or the linear prediction, or may be the one artificially formed by the user.

I claim:

1. An apparatus for forming musical tones comprising:

means for repetitively generating impulse response signals of a predetermined length corresponding to frequency characteristics of a tone signal that is to be generated;

means for changing a recurring period of the impulse response signals repetitively generated depending upon a pitch-determining factor;

means for changing a rate of generating the impulse response signals depending upon a timbre-determining factor different from said pitch-determining factor, independently of said recurring period; and means for changing over a waveform of the impulse response signals that are repetitively generated depending upon a musical factor.

2. The apparatus for forming musical tones according to claim 1, wherein said pitch-determining factor determines a pitch of the tone signal.

3. The apparatus for forming musical tones according to claim 1, wherein said timbre-determining factor determines a timbre of the tone signal.

4. The apparatus for forming musical tones according to claim 1, wherein the impulse response signals are stored in a storage element, a rate of reading the impulse response signals is determined depending upon said timbre-determining factor, and the recurring period for repetitively reading the impulse response signals is determined depending upon said pitch-determining factor.

5. The apparatus for forming musical tones according to claim 1, wherein said musical factor determines a pitch of the tone signal, or is a timbre-determining factor different from said pitch-determining factor.

6. An apparatus for forming musical tones comprising:

means for generating impulse response signals of a predetermined length corresponding to frequency characteristics of a tone signal that is to be generated;

means for controlling said means for generating impulse response signals so that the impulse response signals are repetitively generated with a predetermined period;

means for continuously generating an impulse response signal at an end of the predetermined period when the impulse response signal is longer than the predetermined period and for generating a next impulse response signal in an overlapped manner; and means for changing over a waveform of the impulse response signals that are repetitively generated depending upon a musical factor.

7. The apparatus for forming musical tones according to claim 6, wherein a pitch-determining factor determines a pitch of the tone signal.

8. The apparatus for forming musical tones according to claim 6, wherein a timbre-determining factor determines a timbre of the tone signal.

9. The apparatus for forming musical tones according to claim 6, wherein the impulse response signals are stored in a storage element, a rate of reading the impulse response signals is determined depending upon a timbre-determining factor, and a recurring period for repetitively reading the impulse response signals is determined depending upon a pitch-determining factor.

10. The apparatus for forming musical tones according to claim 6, wherein said musical factor determines a pitch of the tone signal, or is a timbre-determining factor different from a pitch-determining factor.

11. A method of generating musical tones comprising:

repetitively generating impulse response signals of a predetermined length corresponding to frequency characteristics of a tone signal that is to be generated;

changing a recurring period of the impulse response signals repetitively generated depending upon a pitch-determining factor;

changing a rate of generating the impulse response signals depending upon a timbre-determining factor different from said pitch-determining factor, independently of said recurring period; and changing over a waveform of the impulse response signals that are repetitively generated depending upon a musical factor.

12. The method of generating musical tones according to claim 11, wherein said pitch-determining factor determines a pitch of the tone signal.

13. The method of generating musical tones according to claim 11, wherein said timbre-determining factor determines a timbre of the tone signal.

14. The method of generating musical tones according to claim 11, wherein the impulse response signals are stored, a rate of reading the impulse response signals is determined depending upon said timbre-determining factor, and the recurring period for repetitively reading the impulse response signals is determined depending upon said pitch-determining factor.

15. The method of generating musical tones according to claim 11, wherein said musical factor determines a pitch of the tone signal, or is a timbre-determining factor different from said pitch-determining factor.

16. A method of generating musical tones comprising:

generating impulse response signals of a predetermined length corresponding to frequency characteristics of a tone signal that is to be generated;

controlling generation of the impulse response signals so that the impulse response signals are repetitively generated with a predetermined period;

continuously generating an impulse response signal at an end of the predetermined period when the impulse response signal is longer than the predetermined period, and generating a next impulse response signal in an overlapped manner; and changing over a waveform of the impulse response signals that are repetitively generated depending upon a musical factor.

17. The method of generating musical tones according to claim 16, wherein a pitch-determining factor determines a pitch of the tone signal.

18. The method of generating musical tones according to claim 16, wherein a timbre-determining factor determines a timbre of the tone signal.

19. The method of generating musical tones according to claim 16, wherein the impulse response signals are stored, a rate of reading the impulse response signals is determined depending upon a timbre-determining factor, and a recurring period for repetitively reading the impulse response signals is determined depending upon a pitch-determining factor.

20. The method of generating musical tones according to claim 16, wherein said musical factor determines a pitch of the tone signal, or is a timbre-determining factor different from said pitch determining factor.

* * * * *